United States Patent [19]

Lisiecki

[11] Patent Number: 4,927,075

[45] Date of Patent: May 22, 1990

[54] MULTI-PIECE FLAT TOP CONTAINER

[75] Inventor: Robert E. Lisiecki, Bloomfield, Mich.

[73] Assignee: Pure-Pak, Inc., Walled Lake, Mich.

[21] Appl. No.: 374,928

[22] Filed: Jul. 3, 1989

[51] Int. Cl.[5] ..... B65D 43/14

[52] U.S. Cl. ..... 229/125.34; 53/478; 53/491; 229/125.33; 493/102; 493/183

[58] Field of Search ..... 229/125.19, 125.33, 229/125.34, 125.35; 220/258; 53/416, 478, 491; 493/102, 183, 907, 908

[56] References Cited

U.S. PATENT DOCUMENTS

| | | | |
|---|---|---|---|
| 1,394,590 | 10/1921 | Weis | 229/125.35 |
| 2,737,336 | 3/1956 | Moore | 229/125.35 |
| 2,940,654 | 6/1960 | Easter | 229/125.35 |
| 3,124,292 | 3/1964 | Stegner | 229/125.35 |
| 3,762,283 | 10/1973 | Renner | 493/102 |
| 4,397,415 | 8/1983 | Lisiecki | 206/631 |
| 4,842,188 | 6/1989 | Lisiecki | 229/125.33 |

FOREIGN PATENT DOCUMENTS

| | | | |
|---|---|---|---|
| 2448150 | 5/1975 | Fed. Rep. of Germany | 229/125.33 |

*Primary Examiner*—Gary Elkins

*Attorney, Agent, or Firm*—John P. Moran

[57] ABSTRACT

A flat top, thermoplastic coated, paperboard container including a separate cover member and a membrane-type seal, with corner gussets for providing (1) a liquid tight corner construction and (2) top strength and rigitidy for convenient commercial distribution and consumer use. The cover member serves only to protects the membrane, and need only be minimally tack-sealed to the structure to withstand transportation stresses.

12 Claims, 3 Drawing Sheets

FIG. 8
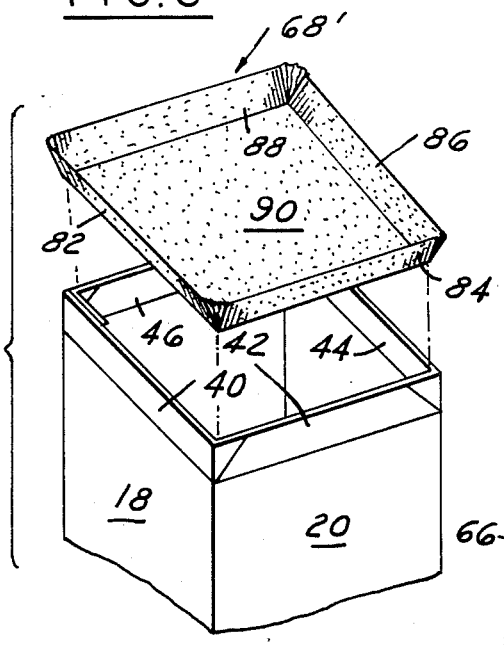
FIG. 9
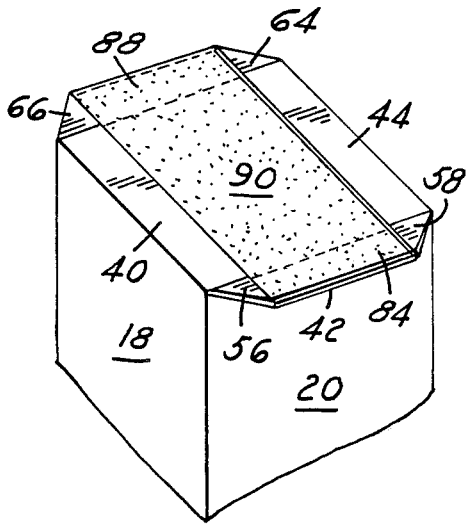
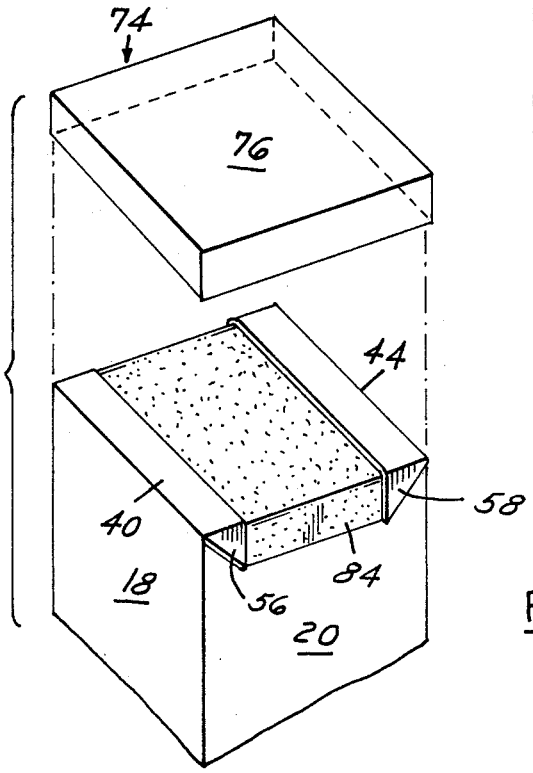
FIG. 10

MULTI-PIECE FLAT TOP CONTAINER

TECHNICAL FIELD

This invention relates generally to thermoplastic coated paperboard containers and, more particularly, to a blank and a container including a separate top end closure with an accompanying membrane seal.

BACKGROUND ART

Containers for beverages such as milk, cream, other dairy products, juices, and the like, are conventionally constructed from the thermoplastic coated paperboard. Typically, these containers include a top end closure with a folded roof structure adaptable to providing a readily available pouring spout when the contents of the container are to be dispensed.

Coated paperboard blanks for constructing such a container are made on converting machines similar to those disclosed by Monroe et al U.S. Pat. No. 2,682,208 and Earp U.S. Pat. No. 3,731,600. After construction, the blanks are processed by forming, filling and sealing machines, such as those disclosed by Monroe et al U.S. Pat. No. 3,303,761, Allen Patent No. 3,918,236, Egleston patent No. 3,398,659 or Young U.S. Pat. No. 4,193,833, to produce the formed, filled and sealed containers of the type referred to above and shown and described in Egleston et al U.S. Pat. No. 3,270,940, or Lisiecki U.S. Pat. No. 4,422,570.

While this type of container has been generally satisfactory for liquid products, it is desirable to utilize a similar square or rectangular thermoplastic coated paperboard container for frozen juices with a modified top closure arrangement which is adaptable to being fully opened, in lieu of using a conventional cylindrical paperboard container with a removable metal or solid plastic top cover. Such a modified top closure arrangement is desirable also for containing and providing access to "spoonable" products, such as yogurt and puddings. One example of a satisfactory top closure of a substantially fully openable type is shown and described in Lisiecki U.S. Pat. No. 4,397,415. A further example of a satisfactory top closure of a completely fully openable type is shown and described in Lisiecki U.S. Pat. No. 4,702,407.

An example of a satisfactory flat top container having a separate cover member is shown and described in Lisiecki patent application No. 225,382.

Young et al U.S. Pat. No. 3,756,500 discloses a corner construction for membrane sealed cartons, including a horizontal score line between the body side panels and the respective end panels which differs from the usual blank arrangement in that at each intersection with a vertical score line, short diagonal lines converge upwardly (away from the adjacent body panels) to an apex at the vertical score line. This results in raised contact areas at each corner once all four end panels are outfolded in a horizontal plane relative to the vertically erected side panels, to provide a frictional area contact at each corner for a sealing membrane applied thereto.

Humphries U.S. Pat. No. 4,304,352 discloses a tray with gusset corners covered by a lid. In this arrangement, the flange sections extend laterally outwardly from their respective side panels, with corners consisting of two triangular gussets folded together and then folded onto and sealed against a side wall.

DISCLOSURE OF INVENTION

A general object of the invention is to provide a thermoplastic coated paperboard container including improved top closure means for providing the above mentioned desirable substantially fully openable feature for particular products, while providing improved seal characteristics at the corners of square or rectangular containers, prior to being easily opened.

Another object of the invention is to provide an improved thermoplastic coated paperboard container suitable for being filled with a juice concentrate and then frozen, or with foodstuffs of a somewhat solid consistency.

A further object of the invention is to provide a square or rectangular paperboard container including an improved, conveniently substantially fully openable flat top closure arrangement.

A still further object of the invention is to provide a flat top container including improved corner gussets for assuring an efficient seal when covered with a membrane of coated paper, plastic film, or coated foil.

Still another object of the invention is to provide a separate top cover whose function is to protect the membrane from mechanical damage during distribution and warehousing.

Other objects and advantages of the invention will become more apparent when reference is made to the following drawings and related description.

BRIEF DESCRIPTION OF DRAWINGS

FIGS. 8–10 are fragmentary perspective views of a further modified version of the invention.

BEST MODE OF CARRYING OUT THE INVENTION

Figure 1:
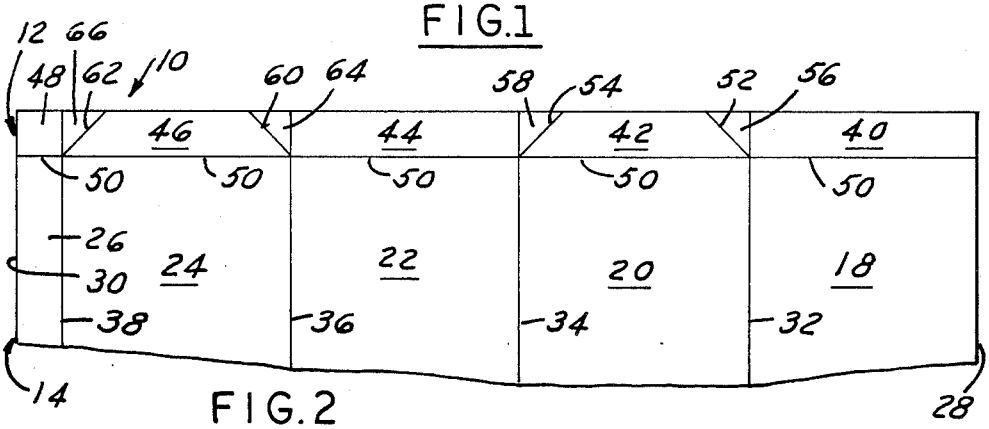
FIG. 1 is a fragmentary layout view of the inside surface of a coated paperboard container blank used to construct a container having a top end closure in accordance with the present invention.

Referring now to the drawings in greater detail, FIG. 1 illustrates a container blank 10 formed in accordance with the principles of the present invention. The container blank 10 is generally divided into three sections including a top fold-over portion 12, a body portion 14, and a conventional flat bottom end closure (not shown). The latter may be any suitable end closure arrangement and is not a part of this invention.

The body portion 14 comprises a plurality of integrally connected body panels, namely, a side panel 18, a front panel 20, a side panel 22 and a back panel 24, and a side seam flap or narrow fifth panel 26 formed adjacent the panel 24. The container blank 10 is defined on its longitudinal sides by edges 28 and 30. The body panels 18, 20, 22 and 24, and the side seam flap 26, are connected by longitudinal score lines 32, 34, 36 and 38. It should be apparent that the body panels may be equal in width and hence, adaptable to forming a square cross-section container, or may be formed such that one pair of alternate body panels is wider than the other pair and, hence, adaptable to forming a rectangular cross-section container.

The top end closure 12 comprises five edge panels 40, 42, 44, 46 and 48 connected by a lateral score line 50 to the tops of the respective body panels 18, 20, 22, 24 and 26. Diagonal score line 52 and 54 are formed on the edge panel 20, extending substantially from the intersections of the score lines 32/50 and 34/50, respectively, forming corner segments 56 and 58, respectively, with the respective longitudinal score lines 32 and 34. Diagonal score lines 60 and 62 are formed on the edge panel 24, extending substantially from the intersections of the score lines 36/50 and 38/50, respectively, forming corner segments 64 and 66, respectively, with the respective longitudinal score lines 36 and 38.

Figure 2:
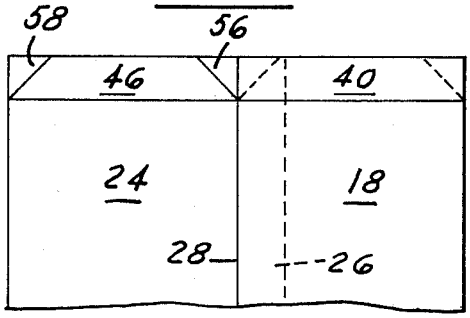
FIG. 2 is a fragmentary layout view of the outsi surface of a blank after it is side seamed from the blank illustrated in FIG. 1.

The container blank 10 illustrated in FIG. 1 is first formed into a side seamed blank as shown in FIG. 2 by rotating the body panel 24 and the side seam flap 26 as a unit about the longitudinal score line 36, and having the inside surfaces of the body panel 24 come into contact with the inside surface of the body panel 22, with the longitudinal score line 38 positioned next to the longitudinal score line 34, and with the inside surface of the side seam flap 26 contacting the inside surface of the body panel 20 adjacent the longitudinal score line 34. The body panel 18 is then rotated about the longitudinal score line 32 to bring its inside surface into contact with the inside surface of the body panel 20. The inside surface of the body panel 18 along the portion adjacent the edge 28 comes into contact with the outside surface of the side seam flap 26, and the edge 28 is positioned parallel and aligned with the longitudinal score line 38. The various members of a bottom end closure will make similar movements. Insofar as the top end closure 12 is concerned, the edge panel 46 overlies the edge panel 44, the edge panel 48 overlies a portion of the edge panel 42, and the edge panel 40 overlies the edge panels 42 and 48. The container blank 10 is then sealed where the inside area of the body panel 18 and edge panel 40 come into contact with the outside surfaces of the side seam flap 26 and the edge panel 48.

In the FIG. 1 structure, if desired, in the formation of the side seam blank the side seam panel 26 could be sealed to the outside surface of the adjacent back panel 18, rather than to the inner surface thereof as described above.

Figure 3:
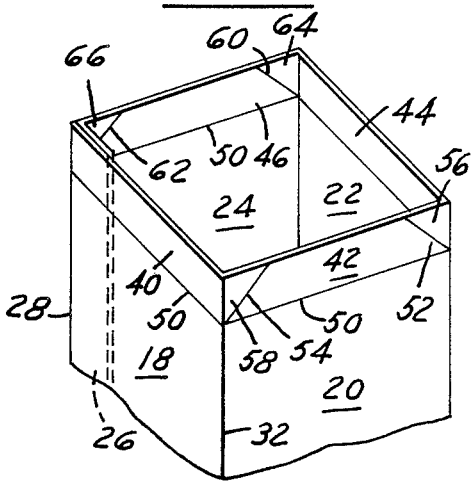
FIGS. 3–6 are fragmentary perspective views illustrating sequentially the steps involved in forming the flat top end closure.
Figure 4:
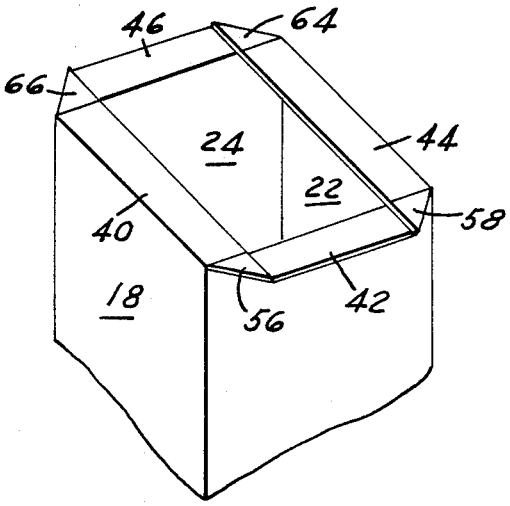

Accordingly, after the side seam blank is opened up into a squared condition shown in FIG. 3, as shown in FIG. 4, the edge panels 42 and 46 are forced outwardly about the respective score lines 50, causing the edge panels 40 and 44 to bend inwardly about their respective score lines 50. Simultaneously, the corner segments 56 and 58 fold back onto the edge panel 42, and the corner segments 64 and 66 fold back onto the edge panel 46.

Figure 5:
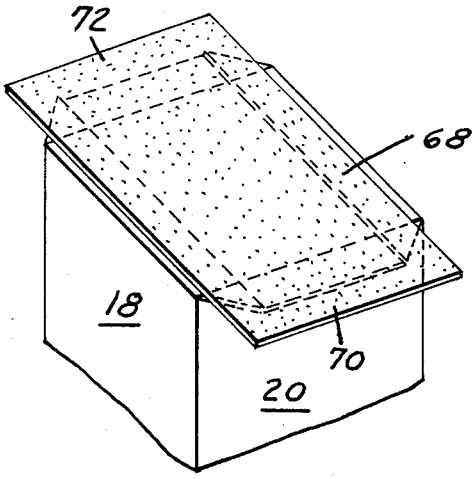

As shown in FIG. 5, a membrane 68, which may consist of coated paper, plastic film, or coated foil, depending upon the market application, approximately the width of the front and back panels 20 and 24, and a length a predetermined amount longer than the combined widths of the side panel 18 and the edge panels 42 and 46, is placed on the upper surfaces of the edge panels 40, 42, 44 and 46, and the corner segments 56, 58, 64 and 66, so as to include portions 70 and 72 extending beyond the outer edges of panels 42 and 46. Sealing of the membrane 68 to the panels 40, 42, 44 and 46 is preferably accomplished by any suitable means, such as a sonic or high frequency vibration sealing means, or gas heat, while these elements are in the planar relationship shown in FIG. 5.

The edge panels 42 and 46, as well as their respective associated corner segments 56/58 and 64/66, and the membrane extensions 70 and 72, along with the portions of the membrane 68 covering the panels 42 and 46, are then folded downwardly into contact with the front and back panels 20 and 24.

Figure 6:
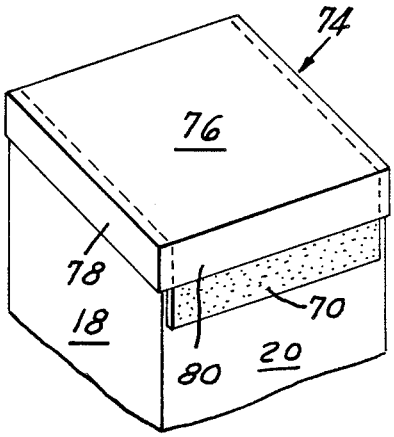

The sealing of the folded-over portions to the respective body panels 20 and 24 is then accomplished by conventional means, such as a sonic or high frequency vibration sealing means, or gas heat. FIG. 6 illustrates the top end closure structure once the sealing thereof has been effected, and the closed top has been covered by a cover member 74. The latter includes a cover panel 76 and four folded-down edge panels, of which two, 78 and 80 are exposed in FIG. 6. The cover member 74 need only be minimally tack-sealed to the container to withstand transportation stresses, since its only function is to protect the membrane 68 from mechanical damage during distribution and warehousing.

In opening the carton, once the cover member 74 has been removed, the membrane 68 is peeled off by first lifting the portion 70. This can be accomplished cleanly, without delamination or fiber tear.

Figure 7:
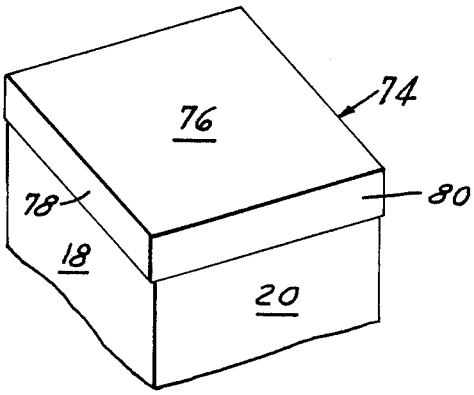
FIG. 7 is a fragmentary perspective view showing the container after the top closure has been sealed closed, but with a modified version of FIGS. 5 and 6.

Referring now to FIG. 7, there is illustrated an alternate embodiment wherein the top portion 12 is the same as for the FIGS. 1–6 arrangement, but wherein the membrane 68 does not include the extended portions 70 and 72. Hence, the membrane is completely covered by the cover member 74.

In the embodiment shown in FIGS. 8–10, a membrane 68' has been placed over the fully open end, such as that shown in FIG. 3, and adapted to being tucked inside against the inside surfaces of each of the edge panels 40, 42, 44, 46 and 48. Specifically, the membrane 68' is formed to include edge portions 82, 84, 86 and 88, and a center portion 90.

When the edge panels 40, 42, 44 and 46 in this relationship are folded as shown in FIG. 9, it's apparent that the side edges 82 and 86 of the membrane 68' will be covered by the respective side edge panels 40 and 44, while the front and back edges 84 and 88 of the membrane lie on top of the respective front and back edge panels 42 and 46. This embodiment is ideal for retaining the raw edges of the side edge panels 40 and 44 on the outside of the membrane for those containers wherein skiving and hemming operations are applied to the edge 30 of the side seam flap 26 to eliminate internal raw edges along the length thereof. A typical skived edge feature is shown and described in U.S. Pat. No. 3,604,317.

Once the front edge panel combination of 42/84 and back edge panel combination of 46/88 are folded down onto the respective body panels 20 and 24 and sealed together and to the body panels. Thereafter the cover member 74 is placed over the top and tack-sealed thereto, as was the case for FIGS. 6 and 7.

In the alternate embodiment arrangements of FIGS. 7–10, once the cover member 74 is lifted off the top closure, the membrane 68 or 68' is more adaptable to being cut away to expose an opening to the contents of the container.

INDUSTRIAL APPLICABILITY

It should be apparent that the invention provides a novel and efficient thermoplastic coated paperboard carton which is ideally suited for being filled with a frozen concentrate, such as orange juice, or with a spoonable product, such as yogurt and puddings, for example, and sealed for distribution through the marketing system, and capable of being readily and easily opened by the consumer.

It should also be apparent that the invention provides a flat top end closure having corner gussets and a membrane seal which cooperate to form a liquid tight and rigid paperboard container for withstanding normal transportation stresses, with a separate cover member serving only to protect the membrane seal from mechanical damage.

While three embodiments of the invention have been shown and described, other modifications thereof are possible within the scope of the following claims.

The embodiments of this invention in which an exclusive property or privilege is claimed are defined as follows:

1. A thermoplastic coated multi-piece falt top container including four respectively adjacent body panels, each connected to the adjacent body panel by a longitudinal score line, two pairs of oppositely disposed top fold-down edge panels connected by a lateral score line to the respective body panels and to each other by extensions of said longitudinal score lines, said lateral score line forming intersections with said longitudinal score lines, a pair of diagonal score lines formed on each of one pair of said oppositely disposed top fold-down edge panels converging substantially from the intersections of the respective longitudinal and lateral score lines across each edge panel and forming a pair of corner gussets on each of the one pair of edge panels, characterized by said one pair of edge panels being folded outwardly and downwardly about said lateral score line onto the respective adjacent body panels, and said corner gussets being folded about said diagonal score line onto their respective edge panels, and the other pair of oppositely disposed top fold-down edge panels being folded inwardly about said lateral score line, and a membrane being sealed onto predetermined surfaces of each of said other pair of edge panels, said corner gussets and said first pair of edge panels.

2. The container described in claim 1, wherein said membrane overlies said four edge panels and said corner gussets.

3. The container described in claim 1, wherein said membrane overlies said first pair of edge panels and underlies said corner gussets and said other pair of edge panels.

4. The container described in claim 1, wherein said membrane includes membrane extensions extending beyond each of said first pair of edge panels, with said membrane extensions being sealed to the respective adjacent body panels, and adapted to being peeled away from all underlying surfaces to open the container.

5. The container described in claim 1, and a cover member mounted over said edge panels and said membrane.

6. The container described in claim 1, wherein said membrane consists of one of coated paper, plastic film, or coated foil.

7. A method of forming an end closure on a thermoplastic coated multi-piece flat container including four respectively adjacent body panels, each connected to the adjacent body panel by a longitudinal score line, two pairs of oppositely disposed top fold-down edge panels connected by a lateral score line to the respective body panels and to each other by extensions of said longitudinal score lines, said lateral score line forming intersections with said longitudinal score lines, a pair of diagonal score lines formed on each of one pair of oppositely disposed top fold-down edge panels converging substantially from the intersections of the respective longitudinal and lateral score lines toward the free edge of each panel and forming a pair of corner gussets on each edge panel, said method comprising the steps of:

(a) folding said one pair of edge panels outwardly and downwardly about said lateral score line onto the respective adjacent body panels;

(b) folding the other pair of oppositely disposed edge panels inwardly about said lateral score line, and said corner gussets about said diagonal score lines onto their respective edge panels of said one pair of edge panels;

(c) mounting a membrane onto predetermined surfaces of said four edge panels and said corner gussets; and (d) sealing said membrane to said adjacent panels and corner gussets.

8. The method described in claim 7, wherein said membrane overlies said four edge panels and said corner gussets.

9. The method described in claim 7, wherein said membrane overlies said one pair of edge panels and underlies said corner gussets and said other pair of edge panels.

10. The method described in claim 7, wherein said membrane includes end portions extending beyond said corner gussets, and sealing the end portions of said membrane onto said adjacent body panels.

11. The method described in claim 7, and the step of mounting a cover member over said edge panels and said membrane.

12. The method described in claim 11, and tack sealing said cover member to said end closure.

* * * * *